US006305956B1

(12) United States Patent
Deng

(10) Patent No.: US 6,305,956 B1
(45) Date of Patent: Oct. 23, 2001

(54) REPLACEABLE PANEL FOR RECEPTACLES

(76) Inventor: C. C. Deng, No. 1, Alley 50, Lane 305, Sec. 3, Chung-Shan Rd., Tantze Haiang, Taichung County (TW)

( * ) Notice: Subject to any disclaimer, the term of this patent is extended or adjusted under 35 U.S.C. 154(b) by 0 days.

(21) Appl. No.: 09/775,578

(22) Filed: Feb. 5, 2001

(51) Int. Cl.[7] ..... H01R 13/44

(52) U.S. Cl. ..... 439/138; 439/136; 439/137; 174/67; D13/139.8

(58) Field of Search ..... 439/136–139; 174/67; D13/139.8

(56) References Cited

U.S. PATENT DOCUMENTS

D. 443,250 * 6/2001 Lee ..... D13/139.8
3,936,122 * 2/1976 Hagelberg ..... 339/41
5,096,432 * 3/1992 Cullen et al. ..... 439/139
5,267,870 * 12/1993 Maresh ..... 439/139
5,866,846 * 2/1999 Huag ..... 174/67
5,902,140 * 5/1999 Cheung et al. ..... 439/139
6,224,401 * 5/2001 Yu ..... 439/139

* cited by examiner

*Primary Examiner*—Paula Bradley
*Assistant Examiner*—Ann McCamey
(74) *Attorney, Agent, or Firm*—Rosenberg, Klein & Lee

(57) ABSTRACT

A receptacle device includes a casing having a plurality of recesses for receiving receptacles therein. Each of said receptacles has two notches in two sides thereof. A panel has two hooks for being engaged with said two notches and at least two holes are defined through said panel and located in alignment with two slots in said receptacle. A pivotable member is pivotably engaged with the panel and a spring is biased between an end of said pivotable member and an inner periphery of said recess. Two plates respectively extend from a side of said pivotable member and each has a sloped surface and seal said two slots in said receptacle. The panel is pivoted when terminal plates of a plug slidably push the two plates of the pivotable member.

5 Claims, 5 Drawing Sheets

REPLACEABLE PANEL FOR RECEPTACLES

FIELD OF THE INVENTION

The present invention relates to a replaceable panel which is snapped on a receptacle and includes a pivotable member blocking the slots in the receptacle to prevent dust entering into the receptacle.

BACKGROUND OF THE INVENTION

A conventional outlet device especially for the outlet device connected to an extension cord generally includes a casing and a plurality of receptacles embedded in the casing. Each of the receptacles has a hot slot, a neutral slot and a ground slot and can be connected with an electric appliance by connected with a plug. However, most of the plugs look alike and normally the users plug in the plugs randomly without suitable management so that the users cannot tell which plug is connected to a specific electric item. This could be confused when one of the plugs has to be removed from the receptacle. In other words, because the conventional receptacle device does not have indexing feature so that the user has to check carefully by touching along the cable connected to each of the plugs to make sure which plug is connected to which electric appliance.

The present invention provides a replaceable panel for outlet device that has a unique color to assist the user to tell the plugs and each panel has a pivotable member to block the slots.

SUMMARY OF THE INVENTION

This invention relates to a receptacle device and comprises a casing having a plurality of recesses defined therein and each recess has a receptacle received therein. Each of said receptacles has at least two slots defined therein and a panel is engaged with one of said recesses. The panel has at least two holes which are located in alignment with said at least two slots in said receptacle. A pin extends from an underside of said panel and a pivotable member is pivotably mounted to said pin. A spring is biased between an end of said pivotable member and an inner periphery of said recess. A receiving hole is defined in said pivotable member and two plates respectively extend from a side of said pivotable member and an inner side of said receiving hole. The two plates each have a slope surface and seal said at least two slots in said receptacle.

The primary object of the present invention is to provide a receptacle device that has panels mounted to the receptacles and each panel has a pivotable member to seal the slots in the receptacle.

These objects, features, aspects and advantages of the present invention will become more obvious from a careful reading of a detailed description provided hereinafter with appropriate reference to the accompanying drawings.

DETAILED DESCRIPTION OF THE INVENTION

Figure 1:
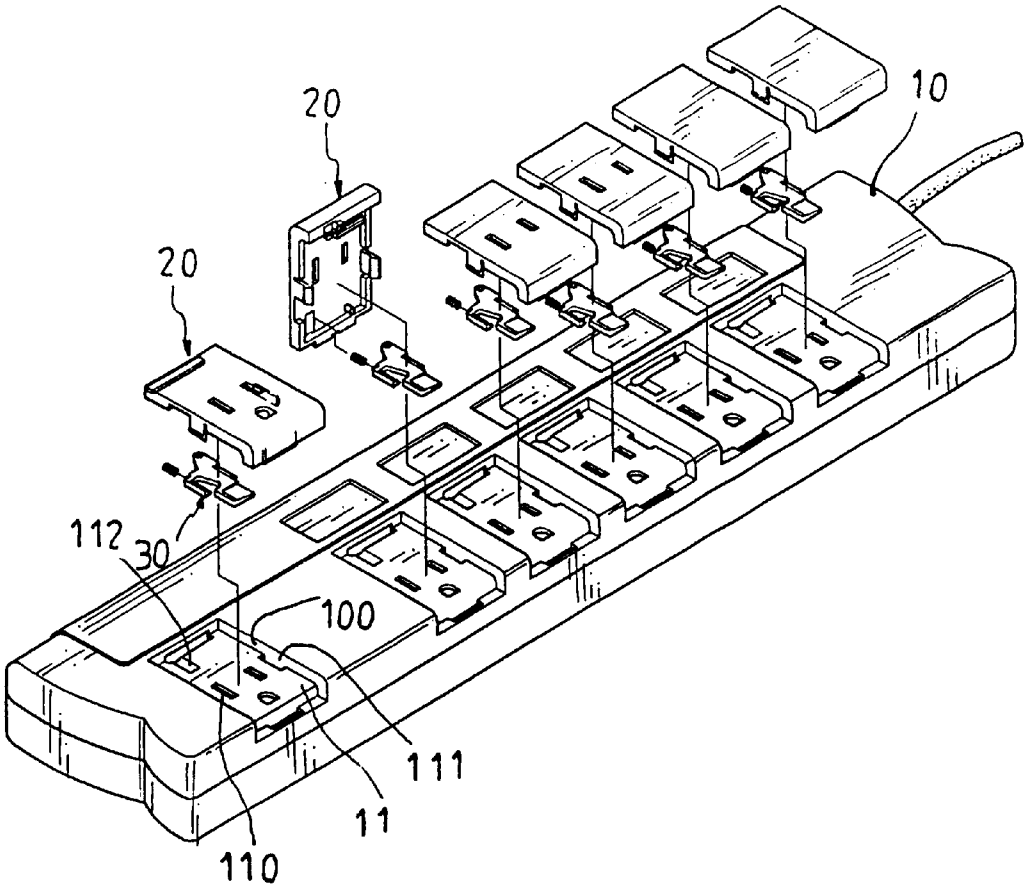
FIG. 1 is an exploded view to show the panels and the receptacle device of the present invention.
Figure 1A:
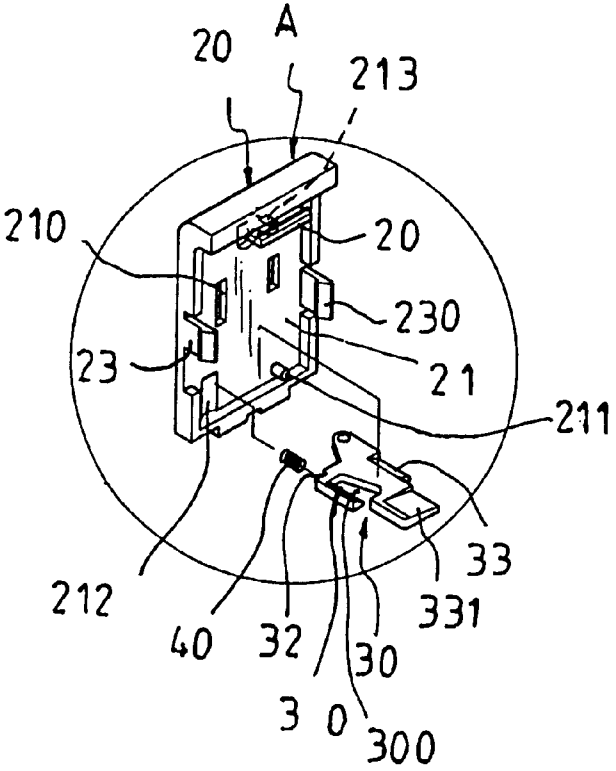
FIG. 1A is an enlarged and exploded view of a panel shown in FIG. 1.
Figure 2:
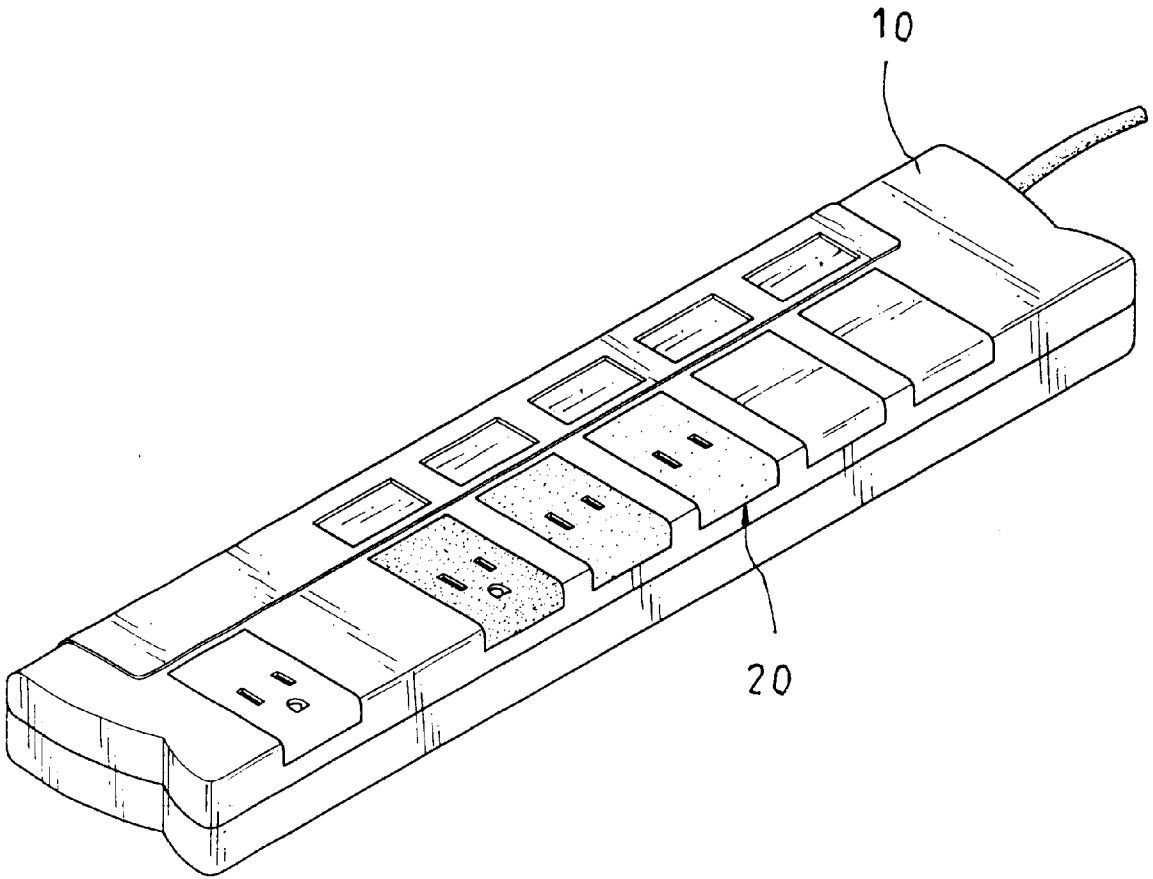
FIG. 2 is a perspective view to show the panels mounted to the receptacles in the receptacle device of the present invention.
Figure 3:
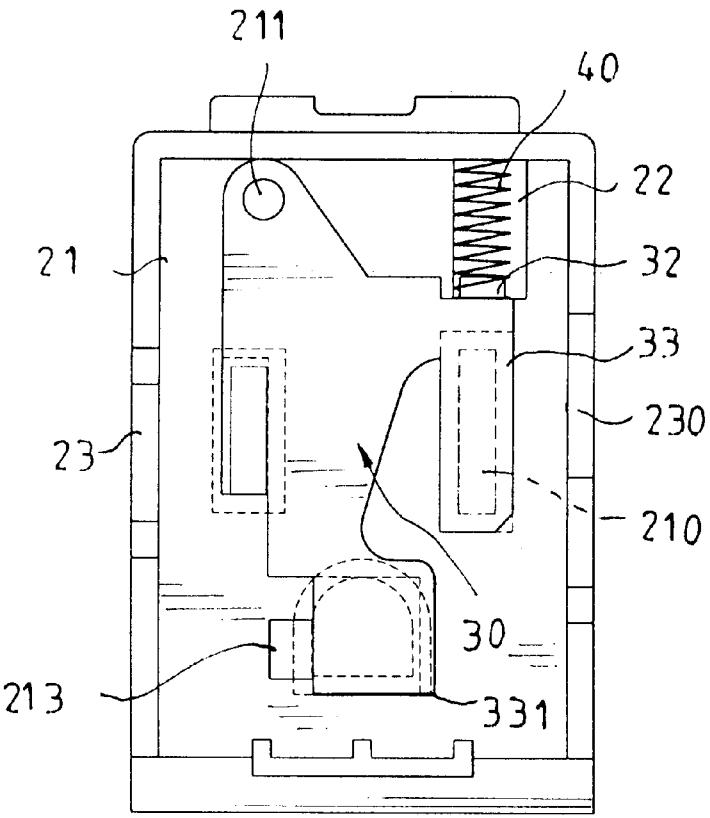
FIG. 3 is a plan view to show the pivotable member sealing the slots of the receptacle.

Reference to FIGS. 1, 2 and 3, the receptacle device of the present invention comprises a casing 10 having a plurality of recesses 100 defined therein and each recess 100 has a receptacle 11 received therein. Each of said receptacles 11 has three slots 110 defined therein and two notches 111 are defined in two sides of said receptacle 11. A receiving recess 112 is defined in said receptacle 11.

A panel 20 has two hooks 23 extending from two sides thereof and said two hooks 23 are engaged with said two notches 111. Three holes 210 are defined through said panel 20 and located in alignment with said three slots 110 in said receptacle 11. A pin 211 extends from an underside of said panel 20.

A pivotable member 30 has an aperture defined therein and said pin 211 is engaged with said aperture. A protrusion 32 extends from an end of said panel 20 so that a spring 40 is received in the receiving recess 112 in said receptacle 11 and mounted to the protrusion 32. Therefore, the pivotable member 30 can be pivoted about the pin 211 by compressing the spring 40 biased between said pivotable member 30 and an inner periphery of said receiving recess 112. A hole 300 is defined in said pivotable member 30 and is in alignment with one of the slots 110 in the receptacle 11. Three plates 33, 330, 331 respectively extend from a side of said pivotable member 30 and an inner side of said hole 300. The three plates 33, 330, 331 each have a sloped surface and seal said three slots 110 in said receptacle 11 when no terminal plates of a plug are inserted into the slots via the holes 210 in the panel 20. A stop 213 extends from said underside of said panel 20 and a side of said pivotable member 30 contacts said stop 213 so as to maintain the position of the three plates 33,330,331.

Figure 4:
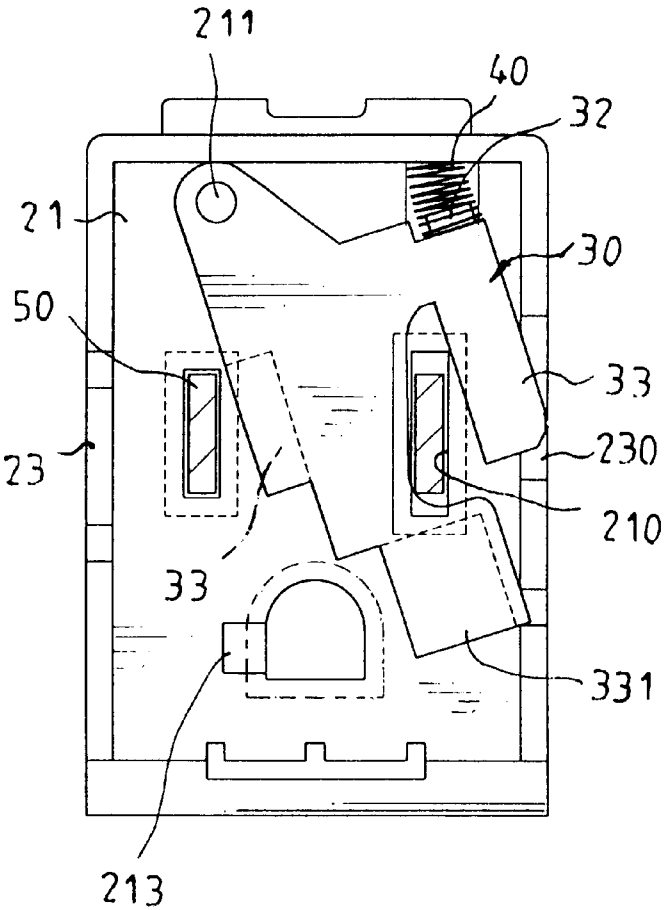
FIG. 4 is a plan view to show the pivotable member is pivoted to allow terminal plates of a plug to insert into the slots of the receptacle.

Referring to FIG. 4, when three terminal plates 50 are inserted into the slots 110 of the receptacle 11 via the holes 210 of the panel 20, the pivotable member 30 is pivoted about the pin 211 and allows the terminal plates 50 to be inserted into the slots 110 because of the slope surface on each of the plates 33, 330, 331.

The panels 20 can be made to have different colors which are advantageous for the user to manage the plugs. The plates 33, 330, 331 block the slots 110 of the receptacle and prevent dust entering the receptacles 11.

Figure 5:
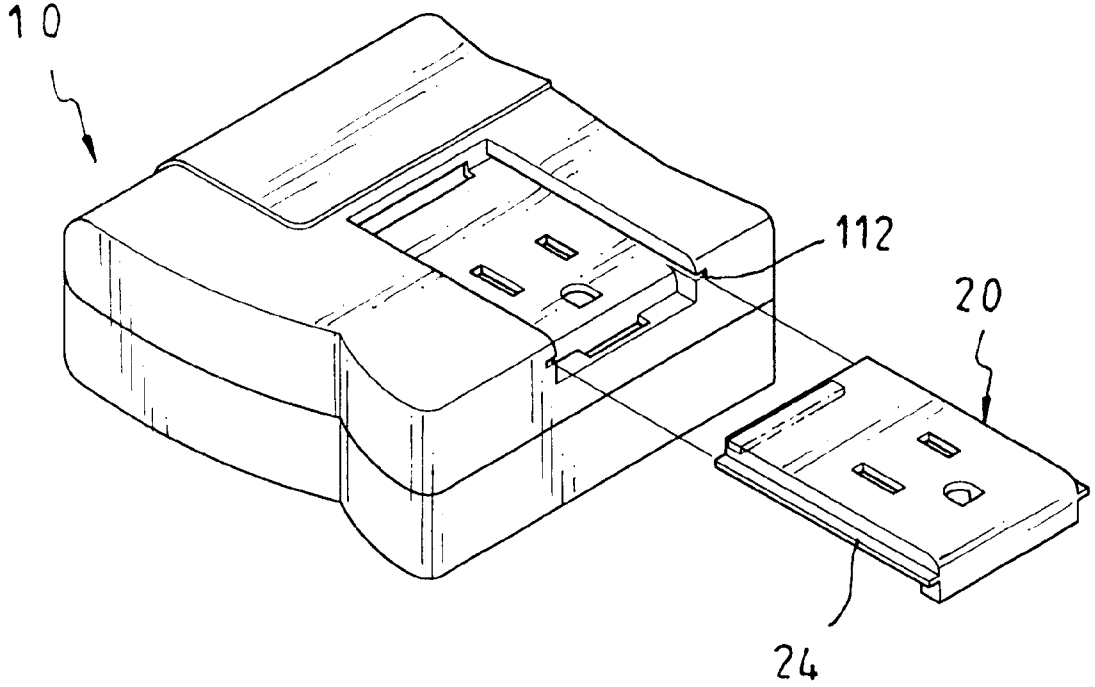
FIG. 5 is an exploded view to show another embodiment of the panel of the present invention.

FIG. 5 shows another embodiment of the connection between the panels 20 and the recesses 100 in the casing 10. Each of said recesses 100 has two grooves 112 defined in two inner sides thereof and each of the panels 20 has two flanges 24 extending from two sides thereof. The two flanges 23 are slidably engaged with said two grooves 112.

Although the present invention has been described with reference to the preferred embodiments, it will be understood that the invention is not limited to the details described thereof. Various substitutions and modifications can be made by those skilled in the art without departing from the scope of the invention as defined in the appended claims.

What is claimed is:

1. A receptacle device comprising:

a casing having a plurality of recesses defined therein and each recess having a receptacle received therein, each of said receptacles having at least two slots defined therein;

a panel engaged with one of said recesses and having at least two holes defined through said panel, said at least two holes located in alignment with said at least two slots in said receptacle, a pin extending from an underside of said panel, and a pivotable member having an aperture defined therein and said pin engaged with said aperture, a spring biased between an end of said pivotable member and an inner periphery of said recess, a receiving hole defined in said pivotable member, two plates respectively extending from a side of said pivotable member and an inner side of said receiving hole, said two plates each having a sloped surface and sealing said at least two slots in said receptacle.

2. The device as claimed in claim 1 further comprising two notches defined in two sides of said receptacle and said panel having two hooks extending from two sides thereof, said two hooks engaged with said two notches.

3. The device as claimed in claim 1 further comprising a receiving recess defined in said receptacle and said spring received in said receiving recess.

4. The device as claimed in claim 1 further comprising a stop extending from said underside of said panel and said pivotable member contacting said stop.

5. A receptacle device comprising:

a casing having a plurality of recesses defined therein and each recess having a receptacle received therein, each of said receptacles having at least two slots defined therein, two grooves defined in two inner sides of said recess;

a panel having two flanges extending from two sides thereof and said two flanges engaged with said two grooves, at least two holes defined through said panel and located in alignment with said at least two slots in said receptacle, a pin extending from an underside of said panel, and a pivotable member having an aperture defined therein and said pin engaged with said aperture, a spring biased between an end of said pivotable member and an inner periphery of said recess, a receiving hole defined in said pivotable member, two plates respectively extending from a side of said pivotable member and an inner side of said hole, said two plates each having a sloped surface and sealing said at least two slots in said receptacle.

* * * * *